US006130991A

United States Patent [19]

Chapman

[11] Patent Number: 6,130,991

[45] Date of Patent: Oct. 10, 2000

[54] CONVECTION SPACE HEATER WITH INTERCONNECTED HOUSING SEGMENTS USING HAIR DRYER AS HEATED AIR SOURCE

[76] Inventor: Lilian E. Chapman, 4140 Red Canyon, Wellington, Nev. 89444

[21] Appl. No.: 09/363,756

[22] Filed: Jul. 29, 1999

[51] Int. Cl.[7] ..... F24D 5/00; F24H 3/00

[52] U.S. Cl. ..... 392/367; 392/385; 392/383; 34/103; 34/104; 34/90; 34/91; 219/533; 219/524; 239/553.3; 239/553.5; 239/590.3; 239/590.5

[58] Field of Search ..... 392/367, 365, 392/368, 360, 363, 364, 379–385, 432; 219/219, 533, 524; 34/91, 90, 96–97, 103–104, 106–107; 239/553, 553.3, 553.5, 590, 590.3, 590.5

[56] References Cited

U.S. PATENT DOCUMENTS

| | | | |
|---|---|---|---|
| 2,523,353 | 9/1950 | Boester | 392/435 |
| 3,688,680 | 9/1972 | Lambert . | |
| 3,892,047 | 7/1975 | Muller-Scherak | 34/103 |
| 4,094,076 | 6/1978 | Baslow | 34/90 |
| 4,316,406 | 2/1982 | Lind . | |
| 4,592,497 | 6/1986 | Georges | 34/104 |
| 4,871,900 | 10/1989 | Hickman | 392/380 |
| 5,014,446 | 5/1991 | Reesman | 34/620 |
| 5,192,348 | 3/1993 | Ludwig . | |
| 5,379,525 | 1/1995 | Raynor | 34/104 |
| 5,389,037 | 2/1995 | Hale . | |
| 5,606,640 | 2/1997 | Murphy | 392/382 |
| 5,769,708 | 6/1998 | Paschke . | |
| 5,873,179 | 2/1999 | Gregory et al. | 34/90 |

FOREIGN PATENT DOCUMENTS

| | | |
|---|---|---|
| 1375666 | 9/1964 | France . |
| 1-296022 | 11/1989 | Japan . |
| 5-138107 | 6/1993 | Japan . |

*Primary Examiner*—John A. Jeffery
*Attorney, Agent, or Firm*—Thomas R. Lampe

[57] ABSTRACT

An electric hair dryer is connected to a portable housing having a plurality of angularly adjustable housing segments. The air passes through the segments and out spaced air outlet openings formed in the housing segments.

1 Claim, 2 Drawing Sheets

CONVECTION SPACE HEATER WITH INTERCONNECTED HOUSING SEGMENTS USING HAIR DRYER AS HEATED AIR SOURCE

TECHNICAL FIELD

This invention relates to a portable heater apparatus for directing heated air from a source of heated air toward an individual. The invention has particular application for use No with an electric hair dryer as the source of heated air. The invention also encompasses a method.

BACKGROUND OF THE INVENTION

Portable heaters are well known devices, typically including a self-contained source of heat energy, such as electrically operated heater coils. Such devices do not always provide a desired distribution of heat. Furthermore, incorporation of electrical coils or other heater elements in the device inherently adds to the expense thereof. Also, self-contained heater units can be dangerous if electrical coils or other sources of heat are placed too close to flammable material or when the devices are improperly positioned. For example, it is not uncommon for such prior art heater devices to be accidentally kicked or pulled over.

As will be seen in greater detail below, the apparatus and method of the invention disclosed herein utilize a portable housing defining a plenum which is connected to the outlet of an electrically operated hair dryer to receive heated air from the dryer and for redistributing the heated air.

U.S. Pat. No. 5,389,037, issued Feb. 14, 1995, discloses a method and apparatus for improving the respiratory efficiency of an infant wherein a fan directs air through a plenum attached to the bars of a crib to create a flow of air toward the baby occupying the crib.

Other air dispersion and diffuser devices are shown in the following United States Patents: U.S. Pat. No. 5,769,708, issued Jun. 23, 1998, U.S. Pat. No. 4,316,406, issued Feb. 23, 1982, U.S. Pat. No. 3,688,680, issued Sep. 5, 1972, and U.S. Pat. No. 5,192,348, issued Mar. 9, 1933.

The patents noted above do not teach or suggest the invention disclosed and claimed herein.

DISCLOSURE OF INVENTION

As indicated above, the present invention incorporates apparatus employed to direct heated air to an individual or other desired object. The apparatus does not incorporate its own heating element. The invention is characterized by its relative simplicity, low cost and ease of use.

The portable heater apparatus disclosed herein is for receiving pressurized heated air from a source of pressurized heated air and distributing the heated air.

The apparatus includes a portable housing defining a plenum and a plurality of spaced air outlet openings communicating with the plenum. Connector means is provided for selectively removably connecting the portable housing to a source of heated air to establish air flow communication between the source of heated air and the plenum whereby heated air received from the source of heated air will be distributed into the plenum, passed through the plenum and exit the plurality of spaced air outlet openings.

The connector means comprises a hair dryer receptacle for receiving the outlet of an electrically powered hair dryer and defining an aperture communicating with the plenum.

The invention also encompasses a method of distributing heated air including the step of energizing an electrically powered hair dryer to produce a flow of heated air from the outlet thereof.

The heated air from the electrically powered hair dryer is introduced into a plenum defined by a portable housing.

The heated air from the plenum is passed through a plurality of spaced air outlet openings defined by the portable housing.

Other features, advantages, and objects of the present invention will become apparent with reference to the following description and accompanying drawings.

BEST MODE FOR CARRYING OUT THE INVENTION

Figure 1:
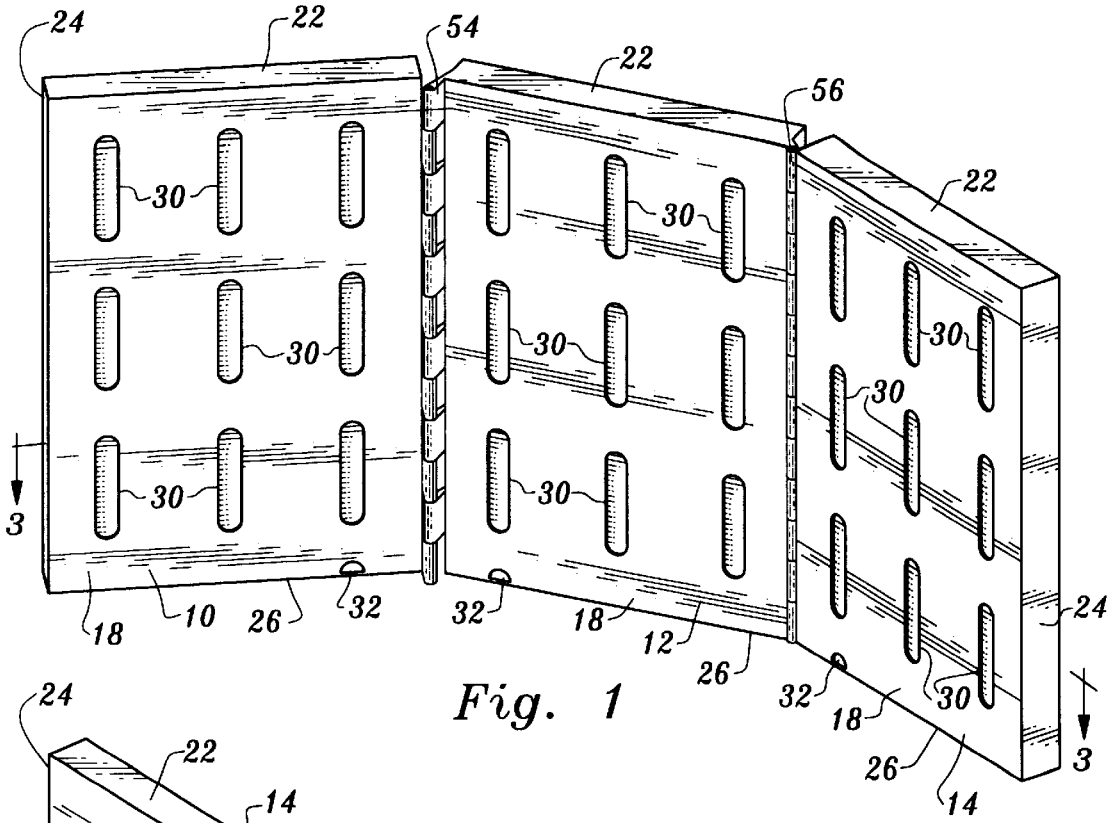
FIG. 1 is a frontal, perspective view of apparatus constructed in accordance with the teachings of the present invention disposed in an operating, non-collapsed configuration.

Referring now to the drawings, portable heater apparatus constructed in accordance with the teachings of the present invention includes a portable housing comprising three housing segments 10, 12, 14 disposed side-by-side.

Figure 3:
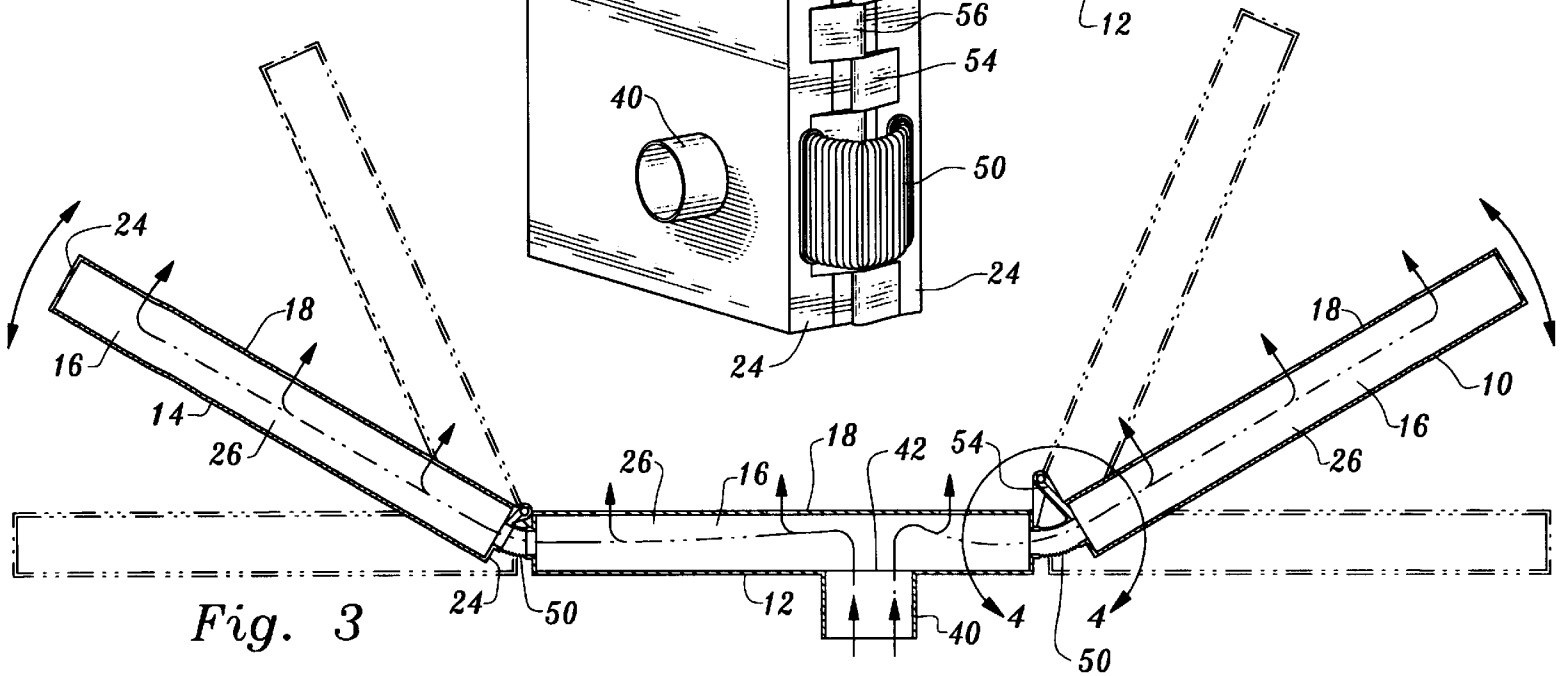
FIG. 3 is a cross-sectional, top plan view of the apparatus illustrating in diagrammatic fashion air flow through the apparatus and illustrating housing segments of the apparatus in alternative relative positions.

The portable housing defines a plenum including a plenum section 16 defined by each of the housing segments (see FIG. 3). Each housing segment includes a front wall 18, a back wall 20, a top wall 22 and two side walls 24. A bottom wall 26 is opposed to each top wall.

The housing segments 10, 12, 14 may be formed of any suitable material such as metal or plastic. Each housing segment has a plurality of air outlet openings 30 communicating with the hollow interiors or plenum sections of the housing segments. These openings 30 are located in front walls 18. In the interest of simplicity not all the air outlet openings have been designated by reference numeral 30. In addition, a drain hole 32 is located at the bottom of each front wall 18 to provide an outlet for any condensation which might form in the housing segments.

Figure 2:
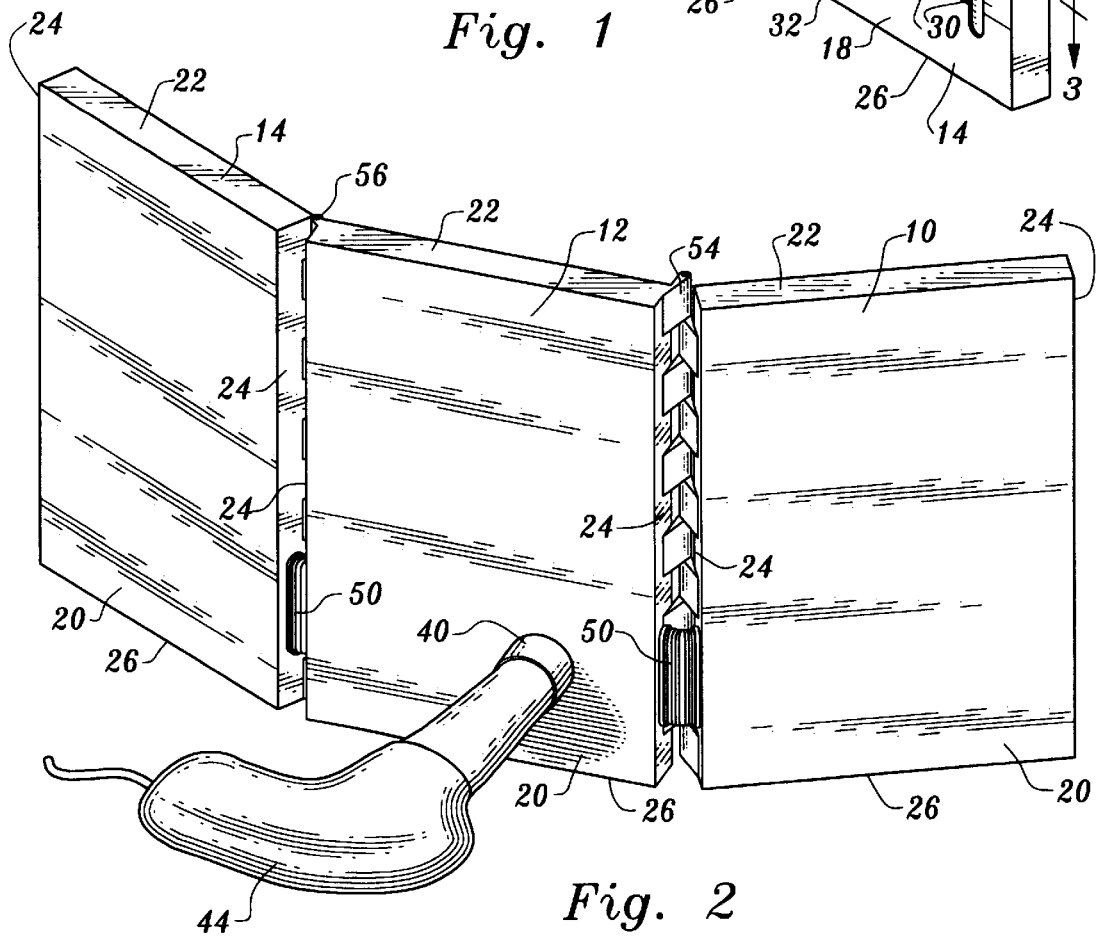
FIG. 2 is a rear, perspective view of the apparatus having the configuration shown in FIG. 1 with an electrically powered hair dryer connected thereto.

Projecting from the back wall 20 of housing segment 12 is a cylindrically-shaped sleeve or receptacle 40 defining an aperture 42 communicating with the plenum section 16 of housing segment 12. As can be seen in FIG. 2, sleeve 40 receives the outlet end of a conventional electrically powered hair dryer 44. When the dryer is activated, hot air will flow from the hair dryer outlet through aperture 42 into plenum section 16 of housing segment 12.

Figure 4:
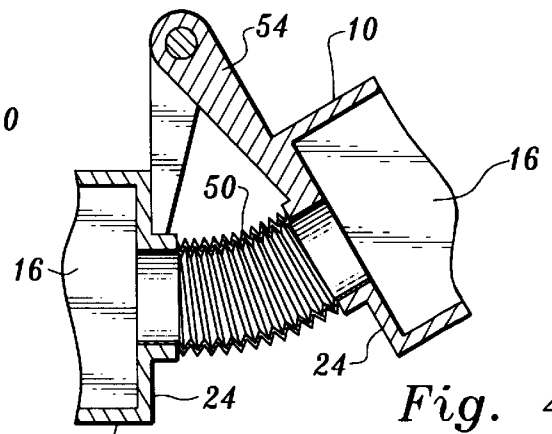
FIG. 4 is a greatly enlarged, cross-sectional, partial, top plan view illustrating portions of adjacent housing segments, a hinge interconnecting the housing segments and an air passageway defined by a collapsible, flexible hose extending between the housing segments in the area denoted by double headed arrow 4 in FIG. 3.

Collapsible, flexible hoses 50 extend between housing segment 12 and housing segment 14 and between housing segment 12 and housing segment 10, the interiors of the hoses 50 allowing passage of air from the central housing segment 12 to the two outer housing segments 10, 14. FIG. 4 provides a more detailed showing of one of the hoses.

A hinge 54 is located between housing segments 12 and 10 and a hinge 56 is located between housing segments 12 and 14. The hinges allow the housing segments to be pivoted and angularly disposed relative to one another. In FIGS. 1 and 2 the housing segments are in relative positions which will allow the apparatus to be free standing. The housing segments may be moved and positioned as desired, a feature which is illustrated in FIG. 3 with the endmost housing segments 10 and 14 being shown in alternate positions. The shapes of the hoses 50 will change, i.e. become shortened or lengthened, depending upon the relative angular orientation of the housing segments to which they are attached. Heated air from hair dryer 44 will pass through the openings 30 in the front walls of all three housing segments as shown by the arrows in FIG. 3 after passing through the plenum sections.

Figure 5:
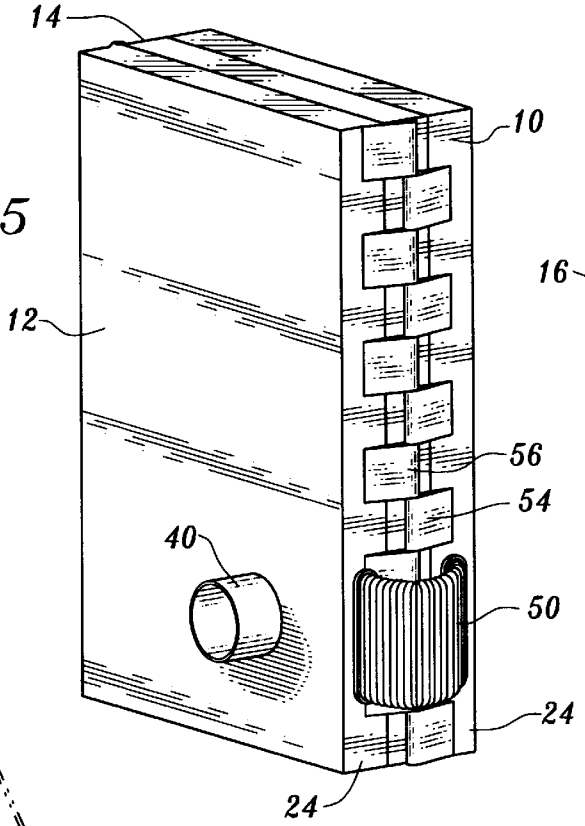
FIG. 5 is a perspective view illustrating the apparatus in collapsed condition.

Hinge 54 is considerably larger than hinge 56, enabling the housing segments to be collapsed as shown in FIG. 5 to provide a compact configuration for storage or transport. When the apparatus is collapsed the housing segments are disposed with the front and back walls thereof parallel and substantially in registry.

According to the method of the present invention an electrically powered hair dryer is energized to produce a flow of heated air from the outlet thereof. The heated air from the electrically powered hair dryer is introduced into a plenum defined by a portable housing.

The heated air from the plenum is passed through a plurality of spaced air outlet openings defined by the portable housing.

The method also includes the step of connecting the outlet of the electrically powered hair dryer to the portable housing prior to the step of introducing heated air from the electrically powered hair dryer into the plenum.

The invention encompasses possible use of sources of heated air other than hair dryers. For example, a floor vent furnishing heat from a furnace can be the source of heat by employing a conduit between the floor vent and portable heater apparatus.

What is claimed is:

1. Portable, collapsible heater apparatus for receiving pressurized heated air from a hair dryer connected to said portable, collapsible heater apparatus and distributing the heated air, said portable heater apparatus comprising, in combination:

a portable housing defining a plenum and a plurality of spaced air outlet openings communicating with said plenum, said portable housing comprising a plurality of rigid, interconnected housing segments, each of said housing segments being hollow and defining a plenum section and at least one of said spaced air outlet openings communicating with the respective plenum section;

air passageway defining means comprising at least one flexible hose extending between adjacent housing segments to provide air flow communication between the plenum sections;

attachment means for attaching said housing segments together in side-by-side relationship; and connector means for selectively removably connecting said portable housing to a hair dryer to establish air flow communication between the hair dryer and said plenum whereby heated air received from the hair dryer will be introduced into said plenum, pass through said plenum and exit all of said plurality of spaced air outlet openings, said connector means comprising a hair dryer receptacle attached to one of said housing segments for receiving the outlet of an electrically Powered hair dryer and defining an aperture communicating with the plenum section thereof, said receptacle comprising a sleeve attached to said one housing segment, said sleeve for surrounding the outlet of an electrically powered hair dryer to support the outlet and maintain a connection between said portable housing and the electrically powered hair dryer, each of said housing segments having a front wall, a back wall, top and bottom walls, and side walls, said attachment means extending between walls of adjacent housing segments and comprising at least one hinge for allowing angular adjustment between adjacent housing segments, said at least one flexible hose being collapsible and varying in configuration responsive to angular adjustment of adjacent housing segments to which said at least one collapsible, flexible hose is connected, said housing segments being relatively movable between a collapsed condition wherein said housing segments are disposed with the front and back walls thereof substantially parallel and substantially in registry and a non-collapsed condition wherein said portable housing is self-supporting and disposed on the bottom walls of the housing segments thereof with the housing segments angularly disposed relative to one another and with at least some of said air outlet openings being spaced above said bottom walls for directing heated hair dryer air passing through said aperture, said plenum sections and said at least one collapsible, flexible hose out of the air outlet openings of all of said housing segments.

* * * * *